US009220990B2

(12) United States Patent
Mataya

(10) Patent No.: US 9,220,990 B2
(45) Date of Patent: Dec. 29, 2015

(54) MULTI-LANE TRACK SYSTEM

(75) Inventor: Ken Mataya, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 458 days.

(21) Appl. No.: 12/887,899

(22) Filed: Sep. 22, 2010

(65) Prior Publication Data

US 2012/0071063 A1 Mar. 22, 2012

(51) Int. Cl.
*A63H 18/00* (2006.01)
*A63H 18/08* (2006.01)
*A63H 18/02* (2006.01)

(52) U.S. Cl.
CPC ..... *A63H 18/023* (2013.01); *A63H 18/00* (2013.01); *A63H 18/08* (2013.01)

(58) Field of Classification Search
CPC ..... A63H 18/00; A63H 18/02; A63H 18/08; A63H 18/028; A63H 19/00; A63H 19/30; A63H 21/02; A63H 21/04; A63H 18/16; A63H 18/023; A63H 19/36
USPC ..... 446/444–446; 238/10 R, 10 C, 10 E; 104/53
See application file for complete search history.

(56) References Cited

U.S. PATENT DOCUMENTS 1,569,225 A * 1/1926 Gunderman ..... 472/6
2,171,634 A * 9/1939 Rexford et al. ..... 104/288
2,254,153 A * 8/1941 Larrabee ..... 446/444
2,534,458 A * 12/1950 Larrabee ..... 238/10 R
2,687,304 A * 8/1954 Northrop et al. ..... 463/62
3,013,726 A * 12/1961 Orel ..... 238/10 E
3,223,417 A * 12/1965 Riso ..... 463/61
3,231,987 A * 2/1966 Schott et al. ..... 434/63
3,313,242 A * 4/1967 Voce ..... 104/60
3,703,989 A * 11/1972 Tomiyama ..... 238/10 E
4,066,211 A * 1/1978 Mak ..... 238/10 F
4,357,877 A * 11/1982 Mariol ..... 104/243
D280,919 S * 10/1985 Petersson ..... D21/565
D287,608 S * 1/1987 Petersson ..... D21/565
D287,609 S * 1/1987 Petersson ..... D21/565
D303,693 S * 9/1989 Petersson ..... D21/565
5,427,561 A * 6/1995 Eichhorn et al. ..... 446/463
D382,026 S * 8/1997 Petersson et al. ..... D21/565
5,704,822 A * 1/1998 Nilsson ..... 446/447
5,779,145 A * 7/1998 Zelle et al. ..... 238/10 E
6,227,932 B1 * 5/2001 Ngai ..... 446/444
6,601,774 B1 * 8/2003 Kasimoff ..... 238/10 R
6,647,893 B1 * 11/2003 Fugitt et al. ..... 104/69
6,648,237 B2 * 11/2003 Rothkopf et al. ..... 238/10 E
6,908,396 B1 * 6/2005 Billig ..... 472/85
6,935,574 B2 * 8/2005 Cheng ..... 238/10 B
7,270,279 B2 * 9/2007 Monk ..... 238/10 F
7,285,035 B1 * 10/2007 Tullis ..... 446/444
2002/0195502 A1 * 12/2002 Delage ..... 238/10 E
2005/0287905 A1 * 12/2005 Olivier ..... 446/108
2012/0252310 A1 * 10/2012 Lin et al. ..... 446/138

* cited by examiner

*Primary Examiner* — Gene Kim
*Assistant Examiner* — Alyssa Hylinski
(74) *Attorney, Agent, or Firm* — Ference & Associates LLC

(57) ABSTRACT

A toy vehicle track kit which imparts a self-guiding capability to a toy vehicles via guide rails interposed between wheels of toy vehicles. The self-guiding capability also permits passing or side-by-side racing of one toy vehicle with respect to another.

16 Claims, 8 Drawing Sheets

MULTI-LANE TRACK SYSTEM

BACKGROUND

Generally, toy vehicles and toy track racing enjoy a storied history. Many pleasant childhood memories are evoked, for instance, of electric slot-car racing and gravity-based "Hot Wheels" racing.

Many children take a liking to toy vehicles of solid, sturdy construction and visual heft as this conveys a sense of durability and reliability that, among other things, constructively reassures children of the likelihood of many years of enjoyment with such vehicles. Such vehicles may be wooden in construction, configured to run on tracks of sizable scale. Such tracks may often deprive children of an otherwise desired level of experiential and vicarious enjoyment, in that a degree of structural and aesthetic bulk is typically imparted to the design of tracks or track segments to permit the vehicles to be guided on the tracks. Similar structural and aesthetic considerations have long applied in the context of toy vehicles and toy tracks that do not involve larger wooden vehicles, as well, resulting overall in a far less than optimal playing experience for the child.

BRIEF SUMMARY

Broadly contemplated herein, in accordance with at least one presently preferred embodiment of the present invention, is a toy vehicle track kit which imparts a self-guiding capability to toy vehicles via guide rails interposed between wheels of toy vehicles. The self-guiding capability also permits passing or side-by-side racing of one toy vehicle with respect to another.

In summary, one aspect of the invention provides a toy vehicle track kit comprising: a toy vehicle, the toy vehicle comprising wheels; a track segment comprising: a base portion; two guide rails extending from the base portion; each the guide rail being disposed and dimensioned for interposition between wheels of the toy vehicle; each the guide rail being disposed and dimensioned for imparting a self-guiding capability to the toy vehicle for travel of the toy vehicle in a direction generally parallel to a longitudinal dimension of each the guide rail; each the guide rail being disposed and dimensioned for interposition between wheels of an additional toy vehicle; the two guide rails being relatively disposed and dimensioned for permitting relative travel of the toy vehicle, with a first of the two guide rails interposed between wheels of the toy vehicle, with respect to and past an additional toy vehicle, with a second of the two guide rails interposed between wheels of an additional toy vehicle.

Another aspect of the invention provides a toy vehicle track segment comprising: a base portion; two guide rails extending from the base portion; each the guide rail being disposed and dimensioned for interposition between wheels of a toy vehicle; each the guide rail being disposed and dimensioned for imparting a self-guiding capability to a toy vehicle for travel of a toy vehicle in a direction generally parallel to a longitudinal dimension of each the guide rail; each the guide rail being disposed and dimensioned for interposition between wheels of an additional toy vehicle; the two guide rails being relatively disposed and dimensioned for permitting relative travel of a toy vehicle, with a first of the two guide rails interposed between wheels of the toy vehicle, with respect to and past an additional toy vehicle, with a second of the two guide rails interposed between wheels of an additional toy vehicle.

For a better understanding of exemplary embodiments of the invention, together with other and further features and advantages thereof, reference is made to the following description, taken in conjunction with the accompanying drawings, and the scope of the claimed embodiments of the invention will be pointed out in the appended claims.

DETAILED DESCRIPTION

It will be readily understood that the components of the embodiments of the invention, as generally described and illustrated in the figures herein, may be arranged and designed in a wide variety of different configurations in addition to the described exemplary embodiments. Thus, the following more detailed description of the embodiments of the invention, as represented in the figures, is not intended to limit the scope of the embodiments of the invention, as claimed, but is merely representative of exemplary embodiments of the invention.

Reference throughout this specification to "one embodiment" or "an embodiment" (or the like) means that a particular feature, structure, or characteristic described in connection with the embodiment is included in at least one embodiment of the invention. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments of the invention. One skilled in the relevant art will recognize, however, that the various embodiments of the invention can be practiced without one or more of the specific details, or with other methods, components, materials, et cetera. In other instances, well-known structures, materials, or operations are not shown or described in detail to avoid obscuring aspects of the invention.

The description now turns to the figures. The illustrated embodiments of the invention will be best understood by reference to the figures. The following description is intended only by way of example and simply illustrates certain selected exemplary embodiments of the invention as claimed herein.

It should be noted that any flowchart and block diagrams in the figures illustrate the architecture, functionality, and operation of possible implementations of apparatuses and methods according to various embodiments of the invention. In this regard, each block in the flowchart may convey one or more functions undertaken in a process, while any functions noted in the block may occur out of the order noted in the figures. For example, two blocks shown in succession may, in fact, be executed substantially concurrently, or the blocks may sometimes be executed in the reverse order, depending upon the functionality involved.

Figure 1:
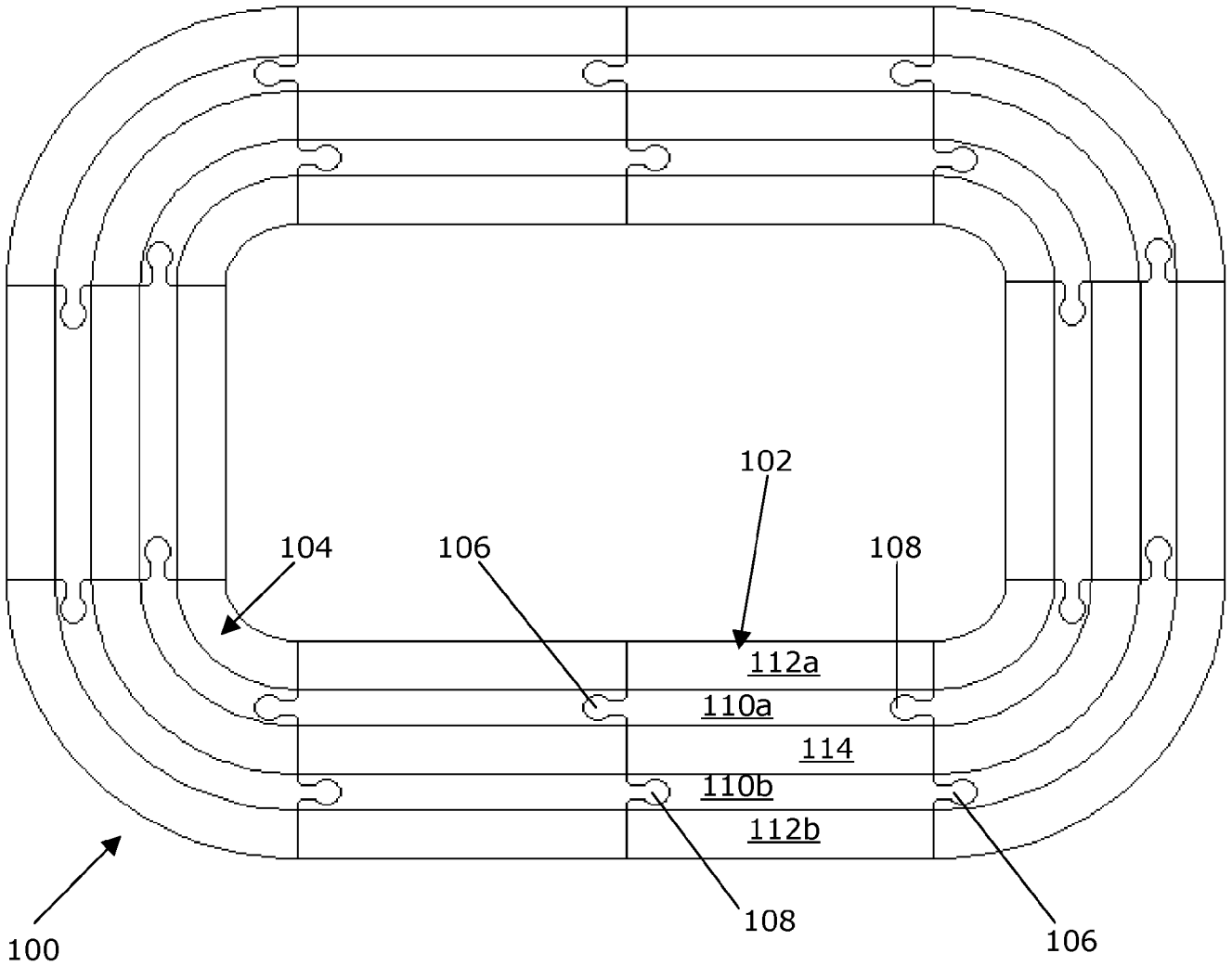
FIG. 1 illustrates in plan view a toy track with several segments.

FIG. 1 illustrates in plan view a toy track with several segments, in accordance with a presently preferred embodiment of the present invention. As shown, track 100 includes several interconnected straight and curved segments, examples of which are indicated at 102 and 104, respectively. Straight segment 102 includes male connectors and female connectors 106 and 108, respectively, configured for mating with compatible female and male connectors, respectively, of other track segments. The track may be formed from wood or from wood in combination with other materials, but of course other types of suitable materials are conceivable within the scope of embodiments of the present invention.

Preferably, segment 102 and analogous segments are configured for imparting a self-guiding capability to wheeled toy vehicles. As such, segment 102 is preferably divided into five longitudinal sections. Two guide rails 110*a/b* preferably extend upwardly from a base portion of segment 102; the makeup and functioning of these rails 110*a/b* will be better appreciated and understood from the ensuing discussion. As such, rails 110*a/b* are each preferably configured for imparting a self-guiding capability to a toy vehicle for travel of a toy vehicle in a direction generally parallel to a longitudinal dimension of each guide rail. In the context of FIG. 1, the direction of travel could be clockwise or counter-clockwise about the track 100.

The rails preferably extend from a base portion that includes outer wheel surfaces 112*a* and 112*b* (each adjacent to rails 110*a* and 110*b*, respectively) and inner wheel surface 114. Preferably, each of the wheel surfaces 112*a/b* and 114 is configured for accommodating wheels of a toy vehicle such that a toy vehicle straddles one of the guide rails 110*a/b*. In other words, to permit travel of a toy vehicle about track 100, the two front wheels of a toy vehicle will flank a guide rail 110*a* or 110*b*, and the two rear wheels of a toy vehicle will do the same.

Preferably, segment 102 does not include side guide rails extending from wheel surfaces 112*a* and 112*b* at the side edges of segment 102, in contrast to conventional toy race tracks which may typically include such side guide rails. It will thus be appreciated that the self-guiding capability afforded by rails 110*a/b* is, in accordance with at least one embodiment of the present invention, preferably sufficient to ensure that toy vehicles will not jump the guide rails 110*a/b* at reasonable speeds of travel, thereby obviating the need for side guide rails as mentioned. By eliminating such side guide rails, it will be appreciated that an enhanced aesthetic quality can be imparted to toy track 100 in that an unimpeded view of toy vehicles on track 100 can be provided without a potentially unsightly visual interposition of such side guide rails.

Preferably, in accordance with at least one embodiment of the present invention, rails 110*a/b* will, in cooperation with wheels of a toy vehicle, be sufficient for keeping a toy vehicle on course or on track without the need for any supplemental guiding elements such as a longitudinal slot which might accommodate a downward extension from a toy vehicle.

Preferably, segment 102 includes male and female connectors 106 and 108, respectively, configured for mating with female and male connectors, respectively, of another track segment. The arrangement and shape of male and female connectors 106/108 shown in FIG. 1 is provided merely by way of illustrative and non-restrictive example, and of course other types of connection arrangements are conceivable within the scope of embodiments of the present invention.

Indicated at 104 is a curved segment that is preferably configured for connection with other segments, such as one or more straight segments such as that indicated at 102. Preferably, curved segment 104 includes features similar to straight segment 102.

Figure 2A:
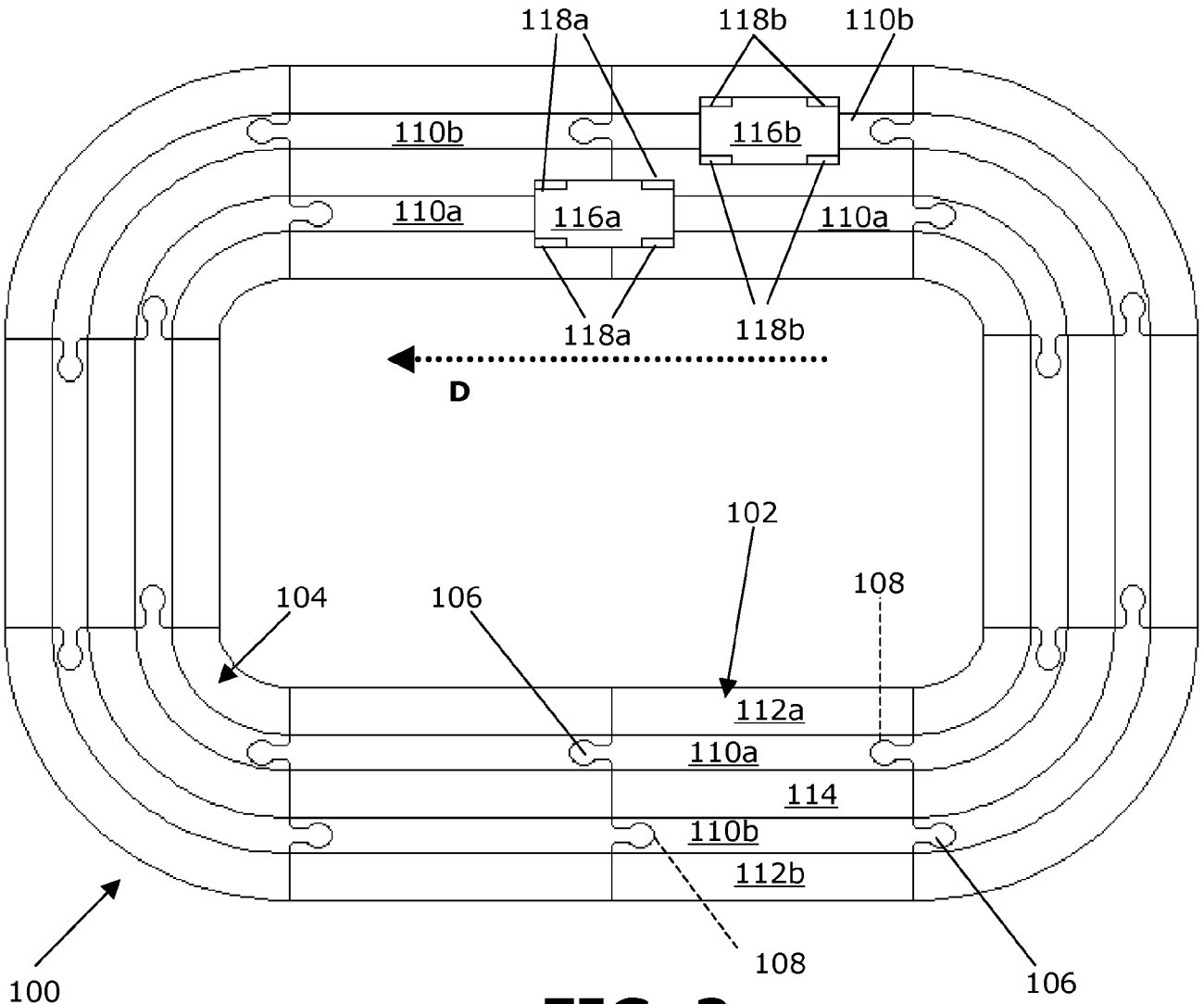
FIG. 2*a*-2*c* provide essentially the same view as FIG. 1, but additionally showing two toy vehicles in varying relative positions.
Figure 2B:
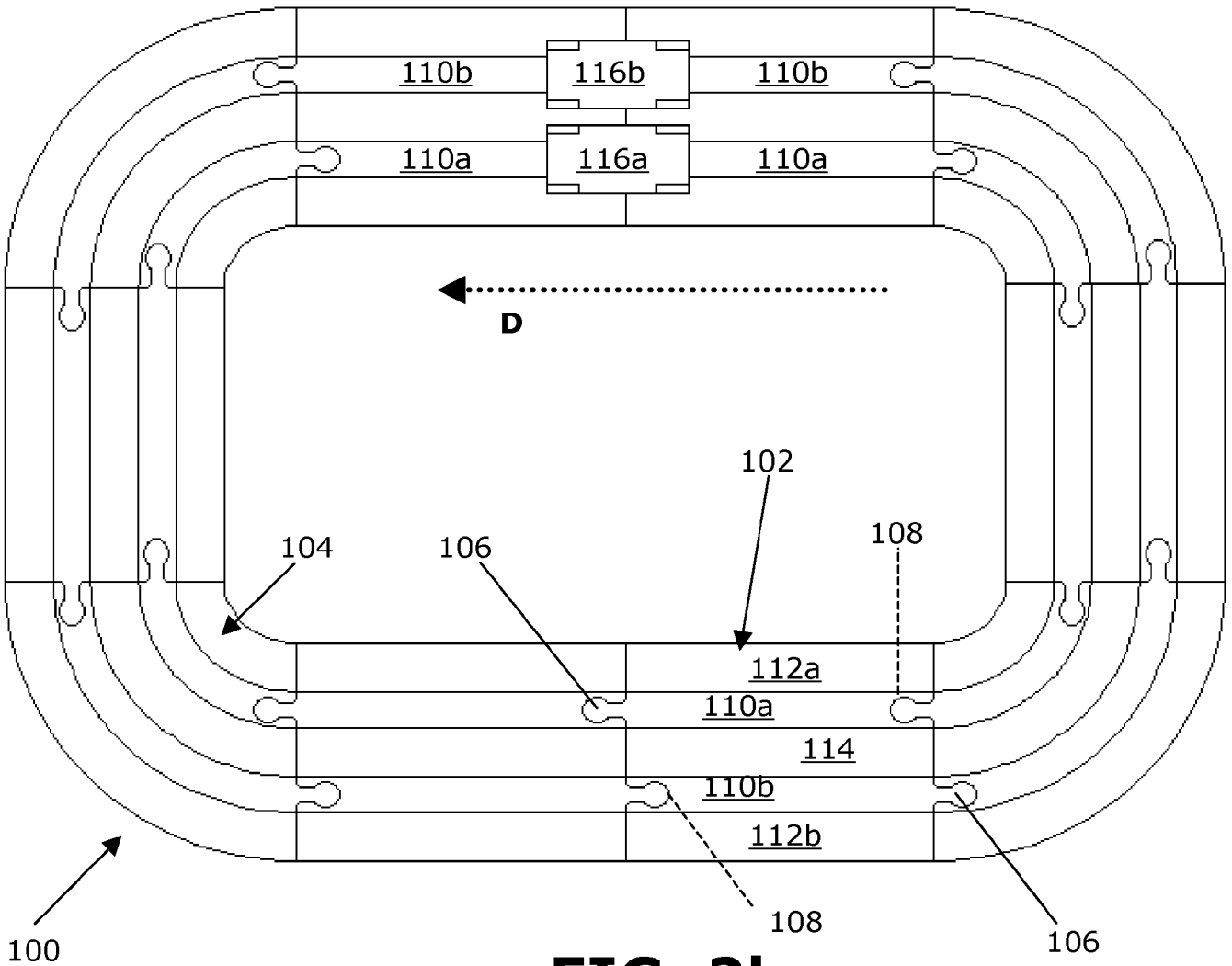
Figure 2C:
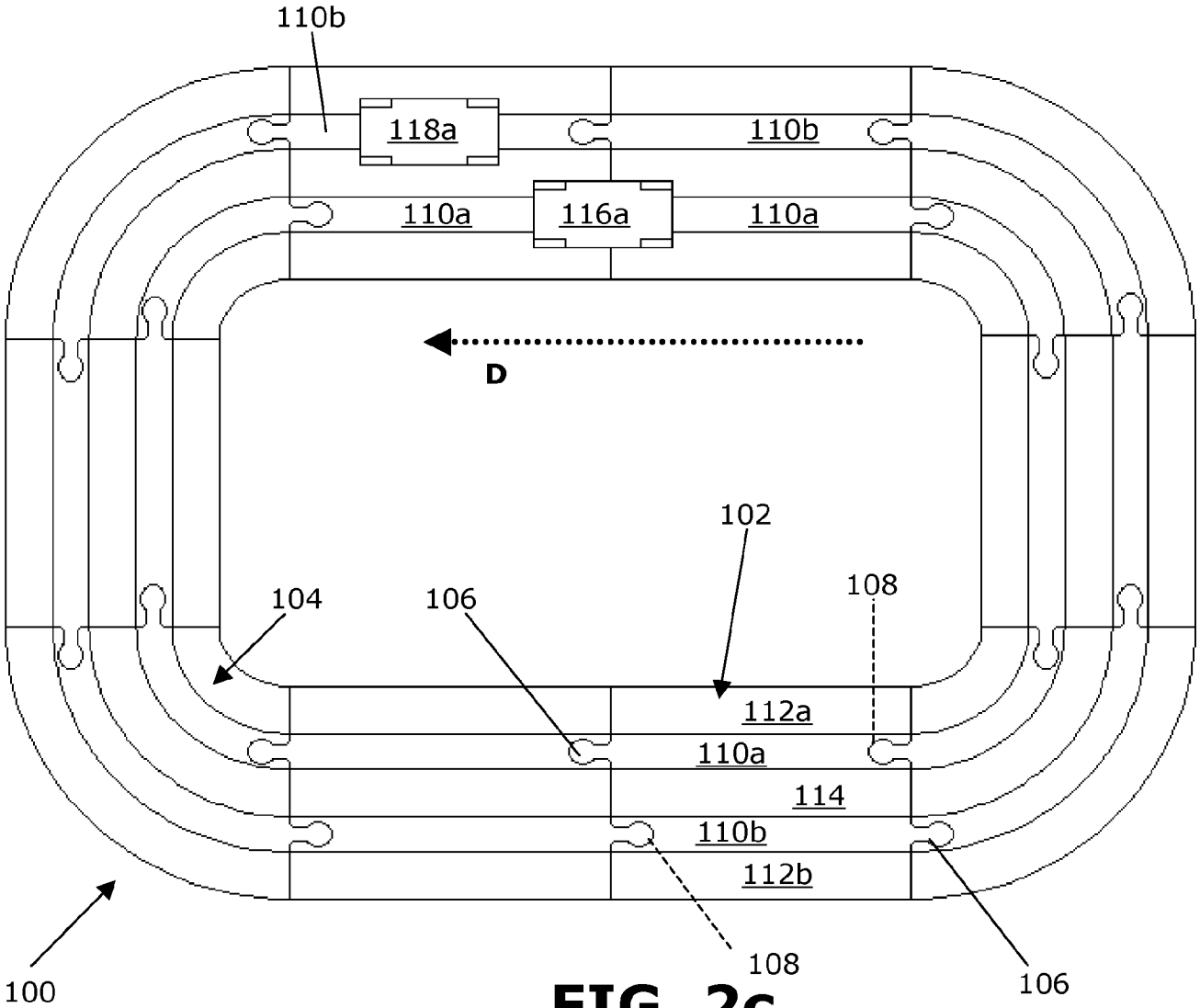

FIG. 2*a*-2*c* provide essentially the same view as FIG. 1, but additionally showing two toy vehicles in varying relative positions. The dotted arrow D shows a counterclockwise direction of travel about track 100 that is considered here for the purposes of illustration.

As shown in FIG. 2*a*, a first toy vehicle 116*a* includes four wheels 118*a*, with guide rail 110*a* being interposed between front and rear pairs, respectively, of the wheels 118*a*. Similarly, second toy vehicle 116*b* includes four wheels 118*b*, with guide rail 110*ba* being interposed between front and rear pairs, respectively, of the wheels 118*b*. The toy vehicles 116*a/b* may include a wooden body and wheels 118*a/b* formed from rubber; however, this is just an example and of course toy vehicles and wheels using other materials are conceivable within the scope of embodiments of the present invention. Toy vehicles 116*a/b* may be propelled in essentially any manner. For instance, they may have a small internal electric or mechanical engine which rotates any or all of the wheels 118*a/b*, or they may include a wind-up mechanism which cocks the wheels 118*a/b* for rotational motion, e.g., via a direct wind-up tool that can be turned by hand or via a self-windup mechanism that is activated by pulling a vehicle 116*a/b* rearwardly on a surface whereby motion of the wheels against direction of travel D provides the wind-up or cocking function.

In FIG. 2*a*, with respect to the direction of travel D, vehicle 116*b* is shown as being behind vehicle 116*a*. FIG. 2*b* provides essentially the same view as FIG. 2*a*, with vehicle 116*b* being shown as even or side-by-side with respect to vehicle 116*a*. FIG. 2*c* provides essentially the same view as FIGS. 2*a* and 2*b*, with vehicle 116*b* being shown as ahead of vehicle 116*a*. It will thus be appreciated from FIGS. 2*a*-2*c* that, in accordance with at least one embodiment of the present invention, guide rails 118*a/b* are relatively disposed and dimensioned to permit relative travel of toy vehicle 116*b* past the other toy vehicle 116*a* while rail 110*a* is interposed between wheels 118*a* of vehicle 116*a* and rail 110*b* is interposed between wheels 118*b* of vehicle 116*b*.

The disclosure now turns to FIGS. 3*a*-6 and a discussion of individual components or segments of a toy race track in accordance with at least one preferred embodiment of the present invention. Various physical dimensions are discussed in the ensuing discussion, and it should be understood that these are provided by way of non-restrictive and illustrative examples only, with the understanding that the exact dimensions shown need not necessarily be applied to bring about the functional features of embodiments of the present invention discussed herethroughout.

Figure 3B:
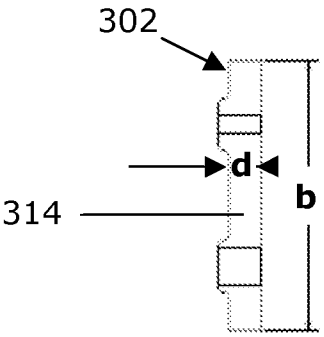
FIGS. 3*a*-3*c* illustrate, respectively, a plan view and two side elevational views of a straight toy track segment.
Figure 3A:
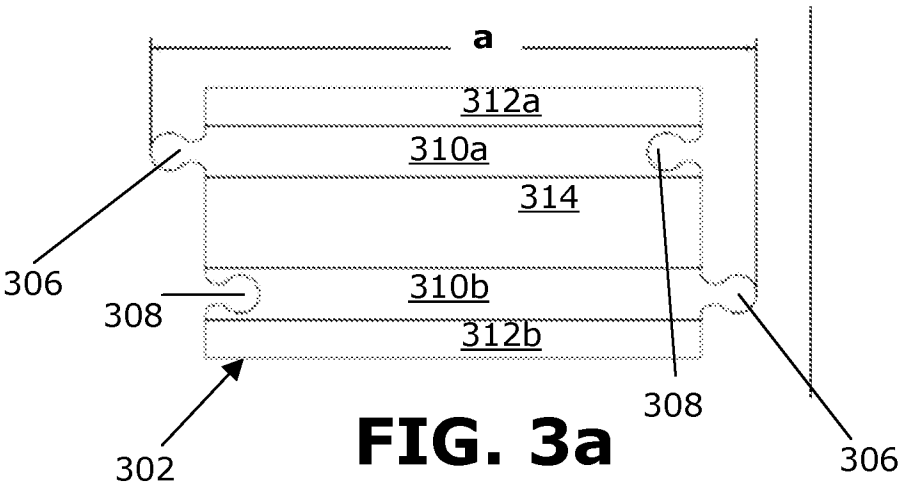
Figure 3C:
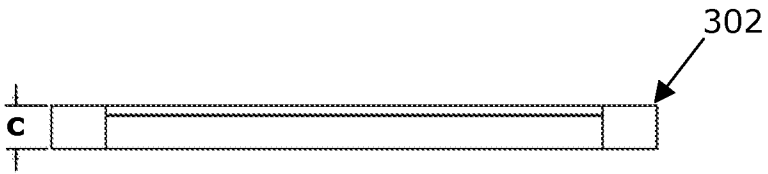

FIGS. 3*a*-3*c* illustrate, respectively, a plan view and two side elevational views of a straight toy track segment 102 by way of illustrating more detail thereof. Segment 302 may be essentially similar in general makeup to that indicated at 102 in FIGS. 1-2*c*; numerals referencing similar components as in FIGS. 1-2*c* are advanced by 200. All three figures may be referred to jointly. A sample dimension a, or a length of segment 102 from apex to apex of male connectors 306, may be about 105 mm. A sample width b, that is, a transverse longitudinal dimension of segment 302, may be about 82.7 mm. An overall sample thickness c, measured with respect to guide rails 310*a/b*, may be about 13.2 mm, while a sample thickness d, measured with respect to wheel surfaces 312*a/b* and 314, may be about 10 mm.

Figure 4:
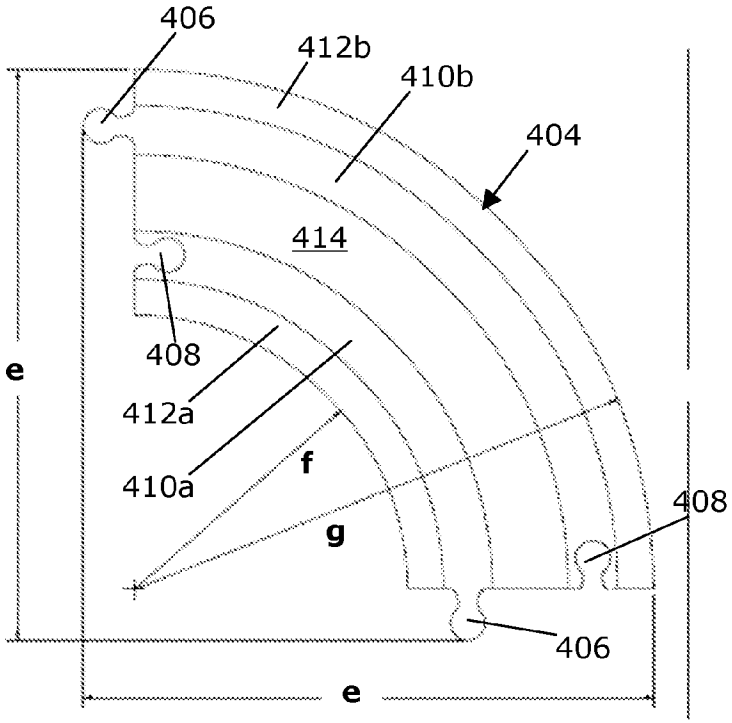
FIG. 4 illustrates a curved track segment in plan view.

Preferably, dimensions of the guide rails 310*a/b* and wheel surfaces 312*a*/312*b*/314 may be similar to or compatible with those of one or more segments with which segment 302 may connect (such as a curved segment 404 as shown in FIG. 4). Such dimensions may also preferably be compatible with those of a track segment (with which segment 302 may connect) lacking guide rails that are to be interposed between wheels of a toy vehicle. For instance, wheel surfaces 312*a*/312*b*/314 may transition into a flat portion of another toy track segment, wherein, to ensure that a toy vehicle stays on course, the other toy track segment may include side guide rails at the longitudinal edges of the segment for lack of guide rails that are to be interposed between wheels of a toy vehicle.

Furthermore, segment 302 may connect with narrower individual track segments that each are configured for accommodating solely one toy vehicle, wherein such a narrower track segment may include side guide rails at the longitudinal edges thereof for lack of any guide rail to be interposed between wheels of a toy vehicle. Segment 302 may in fact connect with two such narrower individual track segments substantially in parallel, wherein a toy vehicle, traveling with respect to guide rail 310*a* such that guide rail 310*a* is interposed between wheels of the toy vehicle, transitions onto a first of two such parallel segments while another toy vehicle, traveling with respect to guide rail 310*b* such that guide rail 310*b* is interposed between wheels of the toy vehicle, transitions onto a second one of the two such substantially parallel segments.

FIG. 4 illustrates a curved track segment 404 in plan view, by way of illustrating more detail thereof. Segment 404 may be essentially similar in general makeup to that indicated at 102 in FIGS. 1-2*c*; numerals referencing similar components as in FIGS. 1-2*c* are advanced by 300. A sample dimension e, or an overall transverse dimension measured from an apex of a mail connector 406 to an outer corner of segment 404, may be about 90.5 mm. A sample inner radius of curvature f of segment 404 may be about 91.3 mm while a sample outer radius of curvature g of segment 404 may be about 173.3 mm.

Preferably, dimensions of the guide rails 410*a/b* and wheel surfaces 412*a*/412*b*/414 may be similar to or compatible with those of one or more segments with which segment 404 may connect (such as a straight segment 302 as shown in FIGS. 3*a-c*). Such dimensions may also preferably be compatible with those of a track segment (with which segment 404 may connect) lacking guide rails that are to be interposed between wheels of a toy vehicle. For instance, wheel surfaces 412*a*/412*b*/414 may transition into a flat portion of another toy track segment, wherein, to ensure that a toy vehicle stays on course, the other toy track segment may include side guide rails at the longitudinal edges of the segment for lack of guide rails that are to be interposed between wheels of a toy vehicle.

Furthermore, segment 404 may connect with narrower individual track segments that each are configured for accommodating solely one toy vehicle, wherein such a narrower track segment may include side guide rails at the longitudinal edges thereof for lack of any guide rail to be interposed between wheels of a toy vehicle. Segment 404 may in fact connect with two such narrower individual track segments substantially in parallel, wherein a toy vehicle, traveling with respect to guide rail 410*a* such that guide rail 410*a* is interposed between wheels of the toy vehicle, transitions onto a first of two such parallel segments while another toy vehicle, traveling with respect to guide rail 410*b* such that guide rail 410*b* is interposed between wheels of the toy vehicle, transitions onto a second one of the two such substantially parallel segments.

Figure 5:
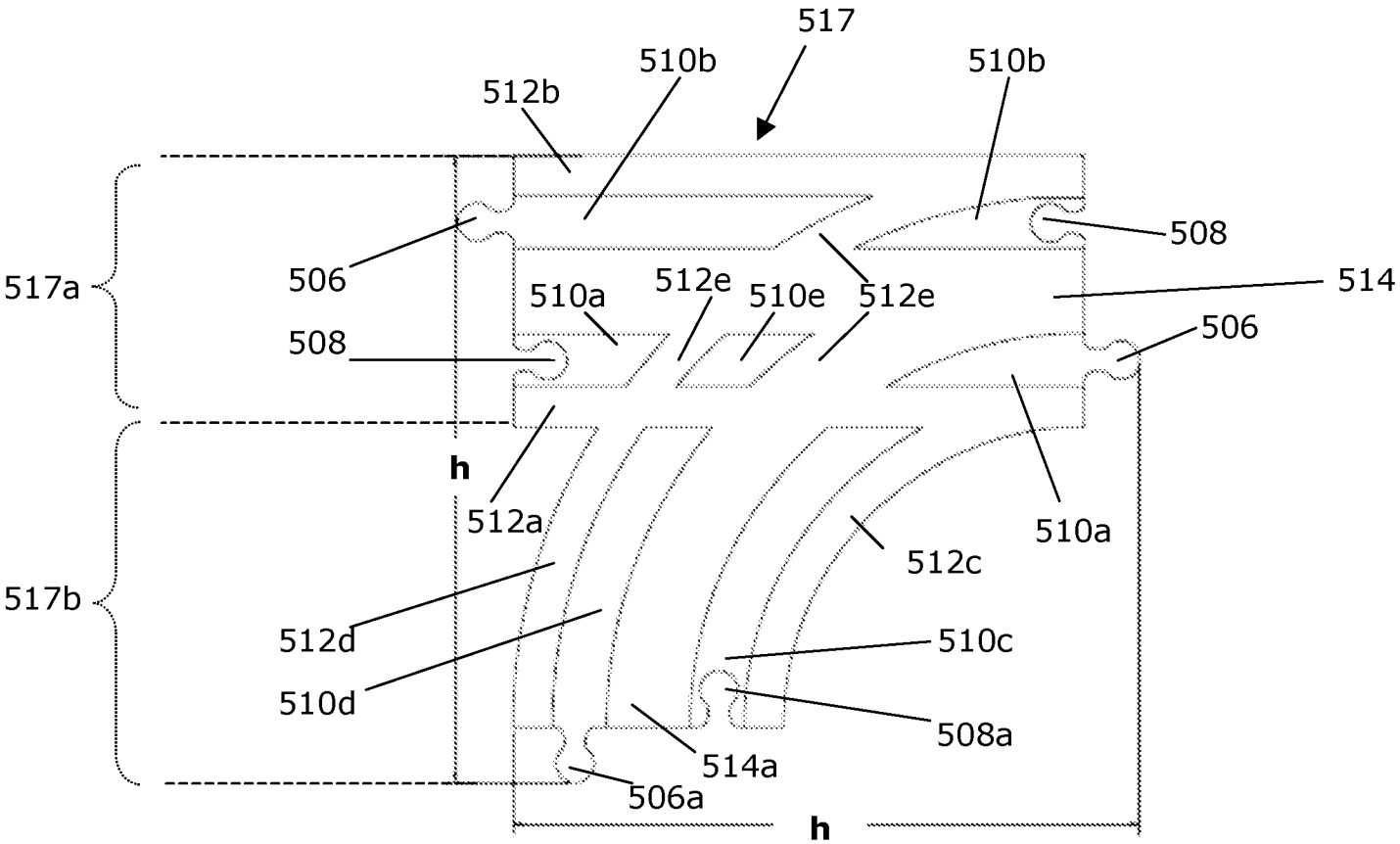
FIG. 5 illustrates a merge track segment in plan view.

FIG. 5 illustrates a merge track segment in plan view, in accordance with at least one presently preferred embodiment of the present invention. Preferably, merge track segment 517 is configured for permitting two different travel paths of toy vehicles to merge with one another, such that travel of one or more toy vehicles from a first track segment (such as a segment 302 from FIGS. 3*a-c*) may merge into travel of one or more toy vehicles from a second track segment (such as a segment 302 from FIGS. 3*a-c*). Segment 517 may include features essentially similar in general makeup to those of a segment 102 from FIGS. 1-2*c*; numerals referencing similar components as in FIGS. 1-2*c* are advanced by 400.

Merge segment 517 preferably includes a first "mainline" portion 517*a* and a second "branch" portion 517*b*, wherein branch portion 517*b* curves to merge into the straighter orientation of mainline portion 517*a*. Mainline portion 517*a* includes guide rails 510*a/b* which are interrupted to accommodate the merging of branch portion 517*b*. Branch portion 517*b*, for its part, preferably includes components similar and analogous to those found in mainline portion 517, including: a first outer wheel surface 512*c* similar and analogous to mainline outer wheel surface 512*a*; a second outer wheel surface 512*d* similar and analogous to mainline outer wheel surface 512*b*; an inner wheel surface 514*a* similar and analogous to mainline inner wheel surface 514; guide rails 510*c/d* similar and analogous to mainline guide rails 510*a/b*, and male/female connectors 506*a/b* similar and analogous to mainline male/female connectors 506/508.

To accommodate the merging with branch portion 517*b*, mainline portion 517*a* preferably includes cuts or openings 512*e* in guide rails 510*a/b* so as to accommodate wheels of a toy vehicle. These cuts/openings 512*e* may be flush with wheel surfaces 512*a/b* and 514 so that a toy vehicle traveling from or to branch portion 517*b* may enjoy a smooth transition while continuing to be guided by a guide rail or portion thereof. An island 510*e*, preferably similar in height to guide rails 510*a/b/c/d*, will preferably be interposed between wheels of a toy vehicle as a toy vehicle transitions from guide rail 510*d* to guide rail 510*b* or vice versa.

A sample dimension h, or an overall transverse dimension measured from an apex of male connector 506*a* to the outer longitudinal edge of wheel surface 512*b*, and/or from an outer corner of branch segment 517*b* to an apex of a male connector 506 as shown, may be about 90.5 mm.

Preferably, dimensions of the guide rails 510*a/b/c/d* and island 510*e* as well as of wheel surfaces 512*a*/312*b*/512*c*/512*d*/514/514*a* may be similar to or compatible with those of one or more segments with which segment 517 may connect (such as a straight segment 302 as shown in FIGS. 3*a-c* or a curved segment 404 as shown in FIG. 4). Such dimensions may also preferably be compatible with those of a track segment (with which segment 517 may connect) lacking guide rails that are to be interposed between wheels of a toy vehicle. For instance, wheel surfaces 512*a*/312*b*/512*c*/512*d*/514/514*a* may transition into a flat portion of another toy track segment, wherein, to ensure that a toy vehicle stays on course, the other toy track segment may include side guide rails at the longitudinal edges of the segment for lack of guide rails that are to be interposed between wheels of a toy vehicle.

Furthermore, segment 517 may connect with narrower individual track segments that each are configured for accommodating solely one toy vehicle, wherein such a narrower track segment may include side guide rails at the longitudinal edges thereof for lack of any guide rail to be interposed between wheels of a toy vehicle. Segment 517 may in fact connect with two such narrower individual track segments substantially in parallel, wherein a toy vehicle, traveling with respect to guide rail 510*a* (or 510*c*) such that guide rail 510*a* (or 510*c*) is interposed between wheels of the toy vehicle, transitions onto a first of two such parallel segments while another toy vehicle, traveling with respect to guide rail 510*b* (or 510*d*) such that guide rail 510*b* (or 510*d*) is interposed between wheels of the toy vehicle, transitions onto a second one of the two such substantially parallel segments.

In a variant embodiment in accordance with the present invention, branch portion 517*b* may be configured and dimensioned solely to accommodate one toy vehicle, such that there is only one guide rail (e.g., similar in dimensioning and positioning to guide rail 510*c*) flanked by two wheel surfaces (e.g., in similar positions as indicated at 512*c* and 514*a*). This single-track branch portion might then only include one connection medium, such as a single female connector in a similar position as 508*a*.

In yet another variant embodiment in accordance with the present invention, branch portion 517*b* may be configured and dimensioned essentially as shown in FIG. 5, e.g., as a "double-track" component, while mainline portion 517*a* may be configured and dimensioned as a "single-track" component, that is, for solely accommodating one toy vehicle. Thus, such a variant embodiment would involve a "double-track" merging into a "single-track", wherein individual elements such as guide rails and wheel surfaces could be configured and dimensioned as appropriate to facilitate such a function.

Figure 6:
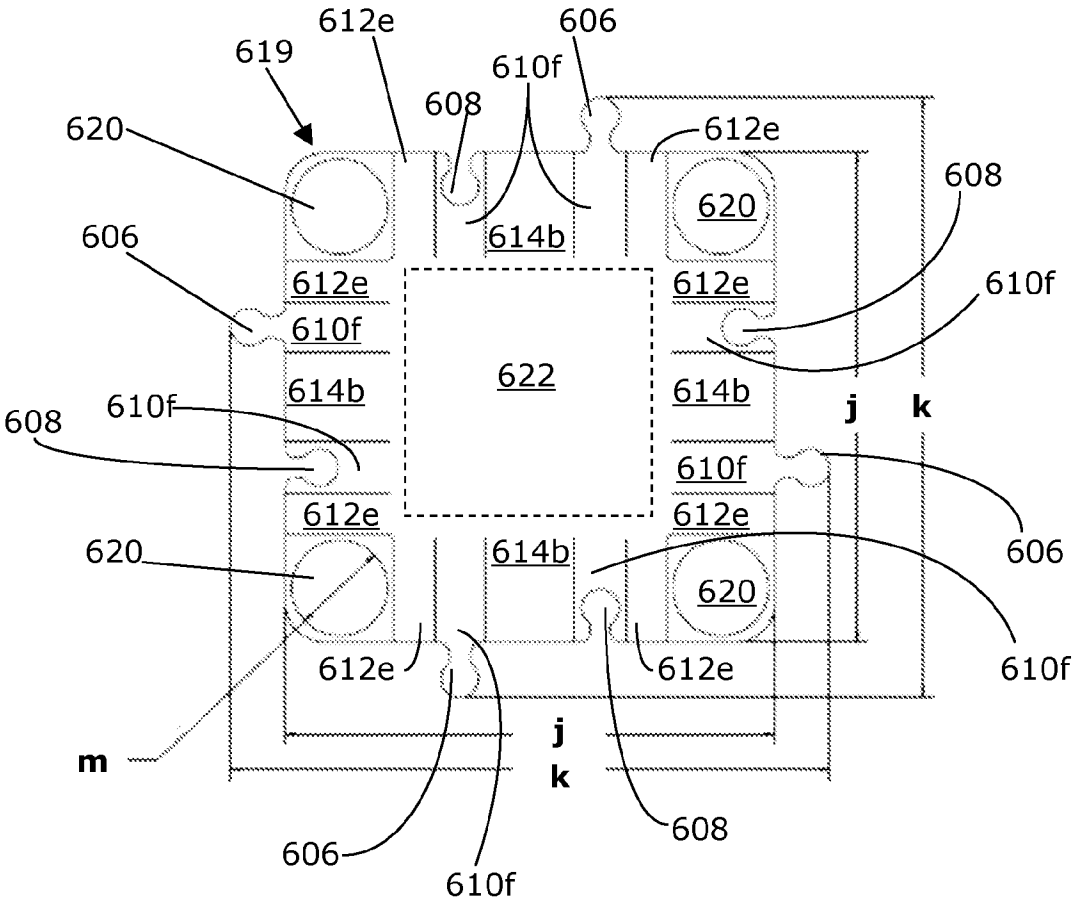
FIG. 6 illustrates an intersection track segment in plan view.

FIG. 6 illustrates an intersection track segment in plan view. Preferably, intersection track segment 619 is configured for permitting two different travel paths of toy vehicles to intersect with one another. The intersection of paths is shown here as being perpendicular, but other angles of intersection are conceivable within the scope of embodiments of the present invention. Segment 619 may include features essentially similar in general makeup to those of a segment 102 from FIGS. 1-2*c*; numerals referencing similar components as in FIGS. 1-2*c* are advanced by 500.

Preferably, as shown, intersection segment 619 may be generally square in orientation so as to accommodate connections with four other segments (or pairs of track segments) on all four sides. For the purposes of the present discussion, the four sides of segment 619 shown in FIG. 6 may be referred to as "north", "south", "east" and "west" in accordance with cardinal directions and as corresponding, respectively to an upward direction, a downward direction, a rightward direction and a leftward direction in the drawing.

Generally, segment 619 is preferably configured to permit the passage of a toy vehicle from west to east (or vice versa) and from north to south (or vice versa). Both generalized paths of travel essentially intersect at an interior passage region 622, which may be considered to be the space within the dotted square in the drawing.

Each of the north, south, east and west sides of segment 619 preferably includes male and female connectors 606/608 for connection with other segments. Also preferably included at each of the north, south east and west sides of segment 619 are stub or truncated portions of guide rails 610*f*, of outer wheel surfaces 612*e* and of inner wheel surfaces 614*b*. Preferably, these stub portions 610*f*/612*e*/614*b* are compatible with guide rails and wheel surfaces of segments with which intersection segment 619 may connect, such as a straight segment 302 as shown in FIGS. 3*a-c*. Thus, guide rail stubs 610*f* may be cooperable with guide rails 310*a/b* such as shown in FIGS. 3*a-c*, such that a height of guide rail stubs 610*f* at the edges of segment 619 is similar to functionally compatible with a height of guide rails of another segment with which segment 619 is to be connected. Similarly, wheel surface stubs 612*e*/614*b* may be dimensioned to be flush with wheel surfaces 310*a*/310*b*/314 such as shown in FIGS. 3*a-c*.

Preferably, guide rail stubs 610*f* taper in height from the outer edges of segment 619 towards passage region 622, whereupon the guide rail stubs 610*f* are essentially flush with the surface of passage region 622. Preferably, each guide rail stub 610*f* is aligned with an opposite guide rail stub 610*f* so that a toy vehicle may reliably travel across the passage region 622 from one guide rail stub 610*f* to the other.

Indicated at 620 are cylindrical holes or recesses into which streetlight accessory parts can be placed, but may be used for essentially any functional purpose.

A sample dimension j, or an overall transverse dimension measured from a major portion of one side of segment 619 to the major portion of an opposite side of segment 619, may be about 151 mm. A sample dimension k, or an overall transverse dimension measured between apices of male connectors 606, may be about 185 mm. A sample diameter m of holes/recesses 620 may be about 29.6 mm.

As mentioned above, preferably, dimensions of the guide rail stubs 610*f* as well as those of wheel surface stubs 612*e*/614*b* may be similar to and compatible with those of one or more segments with which segment 619 may connect (such as a straight segment 302 as shown in FIGS. 3*a-c*). Such dimensions may also preferably be compatible with those of a track segment (with which segment 517 may connect) lacking guide rails that are to be interposed between wheels of a toy vehicle. For instance, wheel surface stubs 612*e*/614*b* may transition into a flat portion of another toy track segment, wherein, to ensure that a toy vehicle stays on course, the other toy track segment may include side guide rails at the longitudinal edges of the segment for lack of guide rails that are to be interposed between wheels of a toy vehicle.

Furthermore, segment 619 may connect with narrower individual track segments that each are configured for accommodating solely one toy vehicle, wherein such a narrower track segment may include side guide rails at the longitudinal edges thereof for lack of any guide rail to be interposed between wheels of a toy vehicle. Segment 619 may in fact connect with two such narrower individual track segments substantially in parallel, wherein a toy vehicle, traveling with respect to a first guide rail stub 610*f*, such that first guide rail stub 610*f* is interposed between wheels of the toy vehicle, transitions onto a first of two such parallel segments while another toy vehicle, traveling with respect to a second guide and parallel guide rail stub 610*f*, such that second guide rail stub 610*f* is interposed between wheels of the toy vehicle, transitions onto a second one of the two such substantially parallel segments.

As mentioned above, an intersection track segment 619 need not necessarily be configured as shown in FIG. 6. For instance, an intersection track segment may be configured to accommodate two intersecting paths of toy vehicle travel that are not substantially perpendicular to one another. Furthermore, it is conceivable to configure an intersection track segment to accommodate three or more intersecting paths of toy vehicle travel. For instance, a hexagonal intersection track segment could be configured to accommodate three intersecting paths of toy vehicle travel that, e.g., may be offset at angles of 60 degrees with respect to one another or an octagonal intersection track segment could be configured to accommodate four intersecting paths of toy vehicle travel that, e.g., may be offset at angles of 45 degrees with respect to one another.

The disclosure hereinabove has focused on toy track systems that permit two toy vehicles to travel or race side-by-side or in parallel with respect to one another over segments that are configured to accommodate two such vehicles engaged in such travel. It should be understood and appreciated that embodiments of the present invention certainly allow for a greater number of toy vehicles, such as three or four or more to vehicles, to travel or race side-by-side or in parallel with respect to one another over segments that are configured to accommodate three or more such vehicles engaged in such travel. Features, dimensions and relative dimensions of tracks and track segments as discussed and illustrated herein can thus certainly be construed as being applicable to segments that permit three or more vehicles to travel or race side-by-side or in parallel with respect to one another.

It should further be appreciated that track segments as discussed and contemplated herein can certainly be configured and dimensioned to freely connect and functionally cooperate with single-track segments of other toy track systems or kits. Connections and interfaces with single-track segments can be appreciated from the foregoing discussion. Thus, an intermingling of track segments from different toy track systems or kits becomes possible, thus enhancing the variety of overall track configurations that can be constructed.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments of the invention have been described herein with reference to the accompanying drawings, it is to be understood that the embodiments of the invention are not limited to those precise embodiments, and that various other changes and modifications may be affected therein by one skilled in the art without departing from the scope or spirit of the disclosure.

What is claimed is:

1. A toy vehicle track kit comprising:

a toy vehicle, said toy vehicle comprising wheels; and at least two rigid track segments that are connectable together, wherein at least one track segment is curved;

a track segment of the at least two track segments comprising:

a base portion;

two guide rails extending from said base portion;

each of said two guide rails being disposed and dimensioned for imparting a self-guiding capability to said toy vehicle for travel of said toy vehicle in a direction generally parallel to a longitudinal dimension of each of said two guide rails;

at least one of said two guide rails extending from said track segment and terminating to form a unitary male connector portion extending there-from for insertion into a guide rail of another track segment having a female connector portion therein, wherein the unitary male connector portion and the female connector portion are shaped to require vertical joining, whereby, once joined, the at least two rigid track segments resist lateral separation;

each of said two guide rails being disposed on said base portion substantially parallel to one another;

each of said two guide rails extending from said base portion and being dimensioned to substantially occupy an entire distance between wheels of said toy vehicle;

wherein said base portion and said two guide rails define a substantially flat inner wheel surface between said two guide rails;

said inner wheel surface being substantially twice a width of an outer wheel surface and accommodating a wheel of said toy vehicle and a wheel of an additional toy vehicle therein; and wherein said track segment includes two outer wheel surfaces on lateral sides thereof, the two outer wheel surfaces being substantially half the width of the inner wheel surface, co-planar with the inner wheel surface and extending to lateral ends of said track segment.

2. The kit according to claim 1, wherein another of said two guide rails comprises a female connector for connection with another track segment.

3. The kit according to claim 1, wherein the track segment comprises a merge track segment having a connector arrangement for connecting with another track segment;

said merge track segment comprising a first merge region interrupting one of said two guide rails and having the width of the outer wheel surface and a second merge region interrupting the one of said two guide rails and having the twice the width of the outer wheel surface, said first merge region and second merge region permitting travel of said toy vehicle from said track segment to the second track segment.

4. The kit according to claim 3, wherein:

said two guide rails comprise first and second guide rails;

said kit further comprises a third guide rail extending from said base portion;

said third guide rail being disposed and dimensioned for interposition between wheels of said toy vehicle;

said third guide rail being disposed to guide travel of said toy vehicle between the third track segment and the second track segment;

said third guide rail being disposed and dimensioned for imparting a self-guiding capability to said toy vehicle for travel of said toy vehicle in a direction generally parallel to a longitudinal dimension of said third guide rail.

5. The kit according to claim 4, further comprising:

a fourth guide rail extending from said base portion;

said fourth guide rail being disposed and dimensioned for interposition between wheels of said toy vehicle;

said fourth guide rail being disposed to guide travel of said toy vehicle between a fourth track segment and the second track segment;

said fourth guide rail being disposed and dimensioned for imparting a self-guiding capability to said toy vehicle for travel of said toy vehicle in a direction generally parallel to a longitudinal dimension of said fourth guide rail.

6. The kit according to claim 5, wherein said first and said second guide rails are both interrupted to permit merging of said toy vehicle from one of said third and fourth guide rails to said first and second guide rails in said a merge region.

7. The kit according to claim 1, wherein said track segment and said two guide rails are curved.

8. The kit according to claim 1, further comprising an intersection track segment comprising a connector arrangement for connecting with said track segment;

said intersection track segment further comprising a second connector arrangement for connecting with a second track segment;

said intersection track segment comprising a passage region which permits travel of said toy vehicle from said track segment to an additional track segment.

9. The kit according to claim 8, wherein:

said intersection track segment further comprises a third connector arrangement for connecting with a third track segment and a fourth connector arrangement for connecting with a fourth track segment;

said passage region further permitting travel of said toy vehicle from a third track segment to a fourth track segment, wherein a path from said track segment to the second track segment intersects a path from the third track segment to the fourth track segment.

10. The kit according to claim 9, wherein the path from said track segment to the second track segment is substantially perpendicular to the path from the third track segment to the fourth track segment.

11. The kit according to claim 8, wherein:

said intersection track segment comprises guide rail stubs;

said guide rail stubs being disposed and dimensioned to cooperate with guide rails of one or more other track segments to imparting a self-guiding capability to said toy vehicle for travel of said toy vehicle in a direction generally parallel to a longitudinal dimension of said guide rail stubs.

12. The kit according to claim 11, wherein said guide rail stubs taper to be flush with said passage region.

13. A toy vehicle track segment comprising:

a rigid base portion;

two guide rails extending from said base portion;

each of said two guide rails being disposed and dimensioned for imparting a self-guiding capability to a toy vehicle for travel of a toy vehicle in a direction generally parallel to a longitudinal dimension of each said guide rail;

at least one of said two guide rails extending from said track segment and terminating to form a unitary male connector portion extending there-from for insertion into a guide rail of another track segment having a female connector portion therein, wherein the unitary male connector portion and female connector portion are shaped to require vertical joining, whereby, once joined, the at least two rigid track segments resist lateral separation;

each of said two guide rails being disposed on said base portion substantially parallel to one another;

each of said two guide rails extending from said base portion and being dimensioned to substantially occupy an entire distance between wheels of said toy vehicle;

wherein said base portion and said two guide rails define a substantially flat inner wheel surface between said two guide rails;

said inner wheel surface being substantially twice a width of an outer wheel surface and accommodating both a wheel of said toy vehicle and a wheel of an additional toy vehicle therein;

wherein said track segment is curved; and wherein said track segment includes two outer wheel surfaces on lateral sides thereof, the two outer wheel surfaces being substantially half the width of the inner wheel surface, co-planar with the inner wheel surface and extending to lateral ends of said track segment.

14. A toy vehicle track segment comprising:

a rigid base portion;

two guide rails extending from said rigid base portion;

each of said two guide rails extending from said rigid base portion and running substantially parallel to one another, said two guide rails being dimensioned to substantially occupy an entire distance between wheels of a toy vehicle;

at least one of said two guide rails extending from said track segment and terminating to form a unitary male connector portion extending there-from for insertion into a guide rail of another track segment having a female connector portion therein, wherein the unitary male connector portion and the female connector portion are shaped to require vertical joining, whereby, once joined, the at least two rigid track segments resist lateral separation;

said rigid base portion and said two guide rails combining to define a substantially flat inner wheel surface between said two guide rails;

said inner wheel surface being substantially twice a width of an outer wheel surface and accommodating both a wheel of said toy vehicle and a wheel of an additional toy vehicle therein;

said rigid base portion and a first guide rail of said two guide rails combining to form a first outer wheel surface, wherein the first outer wheel surface is substantially half the width of the inner wheel surface, substantially flush with the inner wheel surface and extends to a first outer edge of said base portion;

said rigid base portion and a second guide rail of said two guide rails combining to form a second outer wheel surface, wherein the second outer wheel surface is substantially half the width of the inner wheel surface, substantially flush with the inner wheel surface and extends to a second outer edge of said base portion; and wherein said track segment is curved.

15. The kit of claim 1, wherein the at least two rigid track segments are made of wood.

16. The kit of claim 15, wherein the male and female connector portions are formed in a standardized shape and joinable with other complementary track kits.

* * * * *